US006913688B2

(12) United States Patent
Coker et al.

(10) Patent No.: US 6,913,688 B2
(45) Date of Patent: Jul. 5, 2005

(54) MULTI-STAGE HYDRODESULFURIZATION OF CRACKED NAPHTHA STREAMS WITH INTERSTAGE FRACTIONATION

(75) Inventors: John C. Coker, Baytown, TX (US); Garland B. Brignac, Clinton, LA (US); Thomas R. Halbert, Baton Rouge, LA (US); John G. Matragrano, Baton Rouge, LA (US); Brij Gupta, Thornhill (CA); Robert C. Welch, Baton Rouge, LA (US); William E. Winter, Jr., Pensacola, FL (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 174 days.

(21) Appl. No.: 10/274,021

(22) Filed: Oct. 18, 2002

(65) Prior Publication Data

US 2003/0106839 A1 Jun. 12, 2003

Related U.S. Application Data

(60) Provisional application No. 60/334,572, filed on Nov. 30, 2001.

(51) Int. Cl.[7] ..... C10G 65/00

(52) U.S. Cl. ..... 208/210; 208/209; 208/213; 208/216 R; 208/59; 208/217

(58) Field of Search ..... 208/59, 209, 210, 208/213, 216 R, 217

(56) References Cited

U.S. PATENT DOCUMENTS

| | | | | |
|---|---|---|---|---|
| 4,140,626 | A | 2/1979 | Bertolacini et al. | 208/216 R |
| 5,985,136 | A | 11/1999 | Brignac et al. | 208/216 R |
| 6,013,598 | A | 1/2000 | Lapinski et al. | 502/305 |
| 6,083,378 | A | 7/2000 | Gildert et al. | 208/209 |
| 6,126,814 | A | 10/2000 | Lapinski et al. | 208/217 |
| 6,231,753 | B1 | 5/2001 | McKnight et al. | 208/217 |
| 6,303,020 | B1 | 10/2001 | Podrebarac et al. | 208/210 |

OTHER PUBLICATIONS

S. J. Tauster, et al., "Structure and Properties of Molybdenum Sulfide: Correction of $O_2$ Chemisorption with Hydrodesulfurization Activity," Journal of Catalysis 63, pp. 515–519 (1980).

*Primary Examiner*—Walter D. Griffin
(74) *Attorney, Agent, or Firm*—Gerard J. Hughes

(57) ABSTRACT

A process for the selective hydrodesulfurization of olefinic naphtha streams containing a substantial amount of organically bound sulfur and olefins. The olefinic naphtha stream is selectively hydrodesulfurized in a first sulfur removal stage and resulting product stream, which contains hydrogen sulfide and organosulfur is fractionated at a temperature to produce a light fraction containing less than about 100 wppm organically bound sulfur and a heavy fraction containing greater than about 100 wppm organically bound sulfur. The light fraction is stripped of at least a portion ofits hydrogen sulfide and can be collected or passed to gasoline blending. The heavy fraction is passed to a second sulfur removal stage wherein at least a portion of any remaining organically bound sulfur is removed.

15 Claims, No Drawings

MULTI-STAGE HYDRODESULFURIZATION OF CRACKED NAPHTHA STREAMS WITH INTERSTAGE FRACTIONATION

CROSS REFERENCE TO RELATED APPLICATIONS

This case claims benefit of U.S. Provisional Application No. 60/334,572 filed on Nov. 30, 2001.

FIELD OF THE INVENTION

The present invention relates to a process for the selective hydrodesulfurization of olefinic naphtha streams containing a substantial amount of organically bound sulfur ("organosulfur") and olefins. The olefinic naphtha stream is selectively hydrodesulfurized in a first sulfur removal stage and the resulting product stream, that contains hydrogen sulfide and residual organosulfur is fractionated at a temperature that produces a light fraction containing less than about 100 wppm organically bound sulfur and a heavy fraction containing greater than about 100 wppm organically bound sulfur. The light fraction is stripped of at least a portion of its hydrogen sulfide and can be recovered and conducted away from the process for, for example, storage, further processing, or gasoline blending. The heavy fraction is passed to a second sulfur removal stage wherein at least a portion of any remaining organically bound sulfur is removed.

BACKGROUND OF THE INVENTION

Motor gasoline sulfur level regulations are expected to result in a need for the production of less than 50 wppm sulfur mogas by the year 2004, and perhaps levels below 10 wppm in later years. In general, this will require deep desulfurization of catalytically cracked naphthas ("cat naphthas"). Cat naphthas result from cracking operations, and typically contain substantial amounts of both sulfur and olefins. Deep desulfurization of cat naphtha requires improved technology to reduce sulfur levels without the loss of octane that accompanies the undesirable saturation of olefins.

Hydrodesulfurization is a hydrotreating process employed to remove sulfur from hydrocarbon. The removal of feed organosulfur by conversion to hydrogen sulfide is typically achieved by reaction with hydrogen over non-noble metal sulfided supported and unsupported catalysts, especially those of Co/Mo and Ni/Mo. Severe temperatures and pressures may be required to meet product quality specifications, or to supply a desulfurized stream to a subsequent sulfur sensitive process.

Olefinic naphthas, such as cracked naphthas and coker naphthas, typically contain more than about 20 wt. % olefins. At least a portion of the olefins are hydrogenated during the hydrodesulfurization operation. Since olefins are high octane components, for some motor fuel use, it is desirable to retain the olefins rather than to hydrogenate them to saturated compounds that are typically lower in octane. Conventional fresh hydrodesulfurization catalysts have both hydrogenation and desulfurization activity. Hydrodesulfurization of cracked naphthas using conventional naphtha desulfurization catalysts under conventional startup procedures and under conventional conditions required for sulfur removal typically leads to a significant loss of olefins through hydrogenation. This results in a lower grade fuel product that needs additional refining, such as isomerization, blending, etc. to produce higher octane fuels. This, or course, adds significantly to production costs.

Selective hydrodesulfurization, i.e., hydrodesulfurizing a feed with selective catalysts, selective process conditions, or both, may be employed to remove organosulfur while minimizing hydrogenation of olefins and octane reduction. For example, ExxonMobil Corporation's SCANfining process selectively desulfurizes cat naphthas with little or no loss in octane number. U.S. Pat. Nos. 5,985,136; 6,013,598; and 6,126,814, all of which are incorporated by reference herein, disclose various aspects of SCANfining. Although selective hydrodesulfurization processes have been developed to avoid significant olefin saturation and loss of octane, $H_2S$ liberated in the process can react with retained olefins to form mercaptan sulfur by reversion. Such mercaptans are often referred to as "recombinant" or "reversion" mercaptans.

Sulfur removal technologies can be combined in order to optimize economic objectives such as minimizing capital investment. For example, naphthas suitable for blending into a motor gasoline ("mogas") can be formed by separating the cracked naphtha into various fractions that are best suited to individual sulfur removal technologies. While economics of such systems may appear favorable compared to a single processing technology, the overall complexity is increased and successful mogas production is dependent upon numerous critical sulfur removal operations. Economically competitive sulfur removal strategies that minimize capital investment and operational complexity would be beneficial.

Consequently, there is a need in the art for technology that will reduce the cost of hydrotreating cracked naphthas, such as cat naphthas and coker naphthas.

SUMMARY OF THE INVENTION

In accordance with the present invention, there is provided a process for hydrodesulfurizing olefinic naphtha feedstreams and retaining a substantial amount of the olefins, which feedstream boils in the range of about 50° F. (10° C.) to about 450° F. (232° C.) and contains substantial amounts of organically bound sulfur and olefins, which process comprises:

a) hydrodesulfurizing the feedstream in a first sulfur removal stage in the presence of hydrogen and a catalytically effective amount of a hydrodesulfurization catalyst, at hydrodesulfurization reaction conditions including temperatures from about 232° C. (450° F.) to about 427° C. (800° F.), pressures of about 60 to 800 psig, and hydrogen treat gas rates of about 1000 to 6000 standard cubic feet per barrel, to convert at least about 50 wt. % of the organically bound sulfur to hydrogen sulfide and to produce a first product stream containing from about 100 to about 1,000 wppm organically bound sulfur;

b) fractionating said first product stream into a light fraction and a heavy fraction, wherein the fractionation cut point is at a temperature such that the light fraction contains hydrogen sulfide and less than about 100 wppm organically bound sulfur and the heavy fraction contains the remainder of the organically bound sulfur from said product stream;

c) stripping said light fraction of at least a portion of its hydrogen sulfide;

d) conducting the stripped light fraction away from the process to, for example, further processing or to a refinery gasoline pool;

e) conducting said heavy fraction to a second sulfur removal stage wherein the level of the remaining organically bound sulfur is reduced, thereby producing a second product stream.

In a preferred embodiment, the stripped light fraction is combined with the second product stream.

In a preferred embodiment of the present invention the fractionation cut point is such that the light fraction contains less than about 30 wppm organically bound sulfur.

In another preferred embodiment of the present invention, the hydrodesulfurization catalyst is comprised of a Mo catalytic component, a Co catalytic component and a support component, with the Mo component being present in an amount of from 1 to 10 wt. %, calculated as $MoO_3$, and the Co component being present in an amount of from 0.1 to 5 wt. %, calculated as CoO, with a Co/Mo atomic ratio of 0.1 to 1.

In yet another embodiment, the invention relates to a method for regulating the cut-point in the fractionation step of the naphtha desulfurization process (step b, above) in order to provide a target sulfur in a combined stream comprising the stripped light and the second product stream. The target sulfur level will preferably range from about 0 ppm to about 50 ppm, based on the weight of the combined stream.

DETAILED DESCRIPTION OF THE INVENTION

In one embodiment, the feedstock is comprised of one or more olefinic naphtha boiling range refinery streams that typically boil in the range of about 50° F. to about 450° F. The term "olefinic naphtha stream" as used herein are those streams having an olefin content of at least about 5 wt. %. Non-limiting examples of olefinic naphtha streams includes fluid catalytic cracking unit naphtha ("FCC naphtha"), steam cracked naphtha, and coker naphtha. Also included are blends of olefinic naphthas with non-olefinic naphthas as long as the blend has an olefin content of at least about 5 wt. %.

Olefinic naphtha refinery streams generally contain not only paraffins, naphthenes, and aromatics, but also unsaturates, such as open-chain and cyclic olefins, dienes, and cyclic hydrocarbons with olefinic side chains. The olefinic naphtha feedstock typically also contains an overall olefins concentration ranging as high as about 60 wt. %, more typically as high as about 50 wt. %, and most typically from about 5 wt. % to about 40 wt. %. The olefinic naphtha feedstock can also have a diene concentration up to about 15 wt. %, but more typically less than about 5 wt. % based on the total weight of the feedstock. High diene concentrations are undesirable since they can result in a gasoline product having poor stability and color. The sulfur content of the olefinic naphtha will generally range from about 300 wppm to about 7000 wppm, more typically from about 1000 wppm to about 6000 wppm, and most typically from about 1500 to about 5000 wppm. The sulfur will typically be present as organosulfur. That is, organically bound sulfur present as sulfur compounds such as simple aliphatic, naphthenic, and aromatic mercaptans, sulfides, di- and polysulfides and the like. Other organosulfur compounds include the class of heterocyclic sulfur compounds such as thiophene and its higher homologs and analogs. Nitrogen will also be present and will usually range from about 5 wppm to about 500 wppm.

It is highly desirable to remove heteroatom impurities such as sulfur from olefinic naphthas with as little olefin saturation as possible. It is also highly desirable to convert as much as the organic sulfur species of the naphtha to $H_2S$ with as little mercaptan reversion as possible.

The invention relates to the discovery that unexpectedly high levels of sulfur can be removed from an olefinic naphtha stream without excessive olefin saturation or mercaptan reversion taking place. In one embodiment, the process is operated in two sulfur removal stages. The first sulfur removal stage is a hydrodesulfurization stage that typically begins with a feedstock preheating step. The feedstock is typically preheated prior to entering the reactor to a targeted first desulfurization reaction stage inlet temperature. The feedstock can be contacted with a hydrogen-containing gaseous stream prior to, during, and/or after preheating. A portion of the hydrogen-containing gaseous stream can also be added at an intermediate location in the hydrodesulfurization reaction zone. The hydrogen-containing stream can be substantially pure hydrogen or it can be in a mixture with other components found in refinery hydrogen streams. It is preferred that the hydrogen-containing stream have little, more preferably no, hydrogen sulfide. The hydrogen-containing stream purity should be at least about 50% by volume hydrogen, preferably at least about 75% by volume hydrogen, and more preferably at least about 90% by volume hydrogen for best results. It is most preferred that the hydrogen-containing stream be substantially pure hydrogen.

The first sulfur removal stage is preferably operated under selective hydrodesulfurization conditions that will vary as a function of the concentration and types of organosulfur species of the feedstock. By "selective hydrodesulfurization" we mean that the hydrodesulfurization zone is operated in a manner to achieve as high a level of sulfur removal as possible with as low a level of olefin saturation as possible. It is also operated to avoid as much mercaptan reversion as possible. Generally, hydrodesulfurization conditions in the first and second stages are selective hydrodesulfurization conditions, which include: temperatures from about 232° C. (450° F.) to about 427° C., (800° F.) preferably from about 260° C. (500° F.) to about 355° C. (671° F.); pressures from about 60 to 800 psig, preferably from about 200 to 500 psig; hydrogen feed rates of about 1000 to 6000 standard cubic feet per barrel (scf/b), preferably from about 1000 to 3000 scf/b; and liquid hourly space velocities of about 0.5 $hr^{-1}$ to about 15 $hr^{-1}$, preferably from about 0.5 $hr^{-1}$ to about 10 $hr^{-1}$, more preferably from about 1 $hr^{-1}$ to about 5 $hr^{-1}$.

This first sulfur removal stage can be comprised of one or more fixed bed reactors each of which can comprise one or more catalyst beds. Although other types of catalyst beds can be used, fixed beds are preferred. Such other types of catalyst beds include fluidized beds, ebullating beds, slurry beds, and moving beds. Interstage cooling between reactors, or between catalyst beds in the same reactor, can be employed since some olefin saturation can take place, and olefin saturation and the desulfurization reaction are generally exothermic. A portion of the heat generated during hydrodesulfurization can be recovered. Where this heat recovery option is not available, conventional cooling may be performed through cooling utilities such as cooling water or air, or through use of a hydrogen quench stream. In this manner, optimum reaction temperatures can be more easily maintained.

In an embodiment, a catalytically effective amount of one or more hydrotreating catalysts are employed in the first sulfur removal stage. Suitable hydrotreating catalysts may be conventional and include those which are comprised of at least one Group VIII metal, preferably Fe, Co and Ni, more preferably Co and/or Ni, and most preferably Co; and at least one Group VI metal, preferably Mo and/or W, more preferably Mo, on a high surface area support material, preferably alumina. Other suitable hydrotreating catalysts include zeolitic catalysts, as well as noble metal containing catalysts where the noble metal is selected from Pd and Pt.

It is within the scope of the present invention that more than one type of hydrotreating catalyst be used in the same bed or in a stacked bed arrangement. The Group VIII metal is typically present in an amount ranging from about 0.1 to 10 wt. %, preferably from about 1 to 5 wt. %. The Group VI metal will typically be present in an amount ranging from about 1 to 20 wt. %, preferably from about 2 to 10 wt. %, and more preferably from about 2 to 5 wt. %. All metals weight percents are on catalyst. By "on catalyst" we mean that the percents are based on the total weight of the catalyst. For example, if the catalyst were to weigh 100 g. then 20 wt. % Group VIII metal would mean that 20 g. of Group VIII metal was on the support.

Preferably, at least one catalyst in the first sulfur removal stage has the following properties: (a) a $MoO_3$ concentration of about 1 to 10 wt. %, preferably about 2 to 8 wt. %, and more preferably about 4 to 6 wt. %, based on the total weight of the catalyst; (b) a CoO concentration of about 0.1 to 5 wt. %, preferably about 0.5 to 4 wt. %, and more preferably about 1 to 3 wt. %, also based on the total weight of the catalyst; (c) a Co/Mo atomic ratio of about 0.1 to about 1.0, preferably from about 0.20 to about 0.80, more preferably from about 0.25 to about 0.72; (d) a median pore diameter of about 60 Å to about 200 Å, preferably from about 75 Å to about 175 Å, and more preferably from about 80 Å to about 150 Å; (e) a $MoO_3$ surface concentration of about $0.5\times10^{-4}$ to about $3\times10^{-4}$ g. $MoO_3/m^2$, preferably about $0.75\times10^{-4}$ to about $2.5\times10^{-4}$, more preferably from about $1\times10^{-4}$ to about $2\times10^{-4}$; and (f) an average particle size diameter of less than 2.0 mm, preferably less than about 1.6 mm, more preferably less than about 1.4 mm, and most preferably as small as practical for a commercial hydrodesulfurization process unit. The most preferred catalysts will also have a high degree of metal sulfide edge plane area as measured by the Oxygen Chemisorption Test described in "Structure and Properties of Molybdenum Sulfide: Correlation of $O_2$ Chemisorption with Hydrodesulfurization Activity," S. J. Tauster et al., *Journal of Catalysis* 63, pp 515–519 (1980), which is incorporated herein by reference. The Oxygen Chemisorption Test involves edge-plane area measurements made wherein pulses of oxygen are added to a carrier gas stream and thus rapidly traverse the catalyst bed. For example, the oxygen chemisorption will be from about 800 to 2,800, preferably from about 1,000 to 2,200, and more preferably from about 1,200 to 2,000 $\mu$mol oxygen/gram $MoO_3$.

In an embodiment, a supported catalyst is employed in the first stage. Any suitable refractory material, preferably inorganic oxide support materials may be used for the catalyst support. Non-limiting examples of suitable support materials include: zeolites, alumina, silica, titania, calcium oxide, strontium oxide, barium oxide, carbons, zirconia, diatomaceous earth, lanthanide oxides including cerium oxide, lanthanum oxide, neodynium oxide, yttrium oxide, and praesodynium oxide; chromia, thorium oxide, urania, niobia, tantala, tin oxide, zinc oxide, and aluminum phosphate. Preferred are alumina, silica, and silica-alumina. More preferred is alumina. For the catalysts with a high degree of metal sulfide edge plane area of the present invention, magnesia can also be used. It is to be understood that the support material can contain small amount of contaminants, such as Fe, sulfates, silica, and various metal oxides that can be present during the preparation of the support material. These contaminants are present in the raw materials used to prepare the support and will preferably be present in amounts less than about 1 wt. %, based on the total weight of the support. It is more preferred that the support material be substantially free of such contaminants. It is an embodiment of the present invention that about 0 to 5 wt. %, preferably from about 0.5 to 4 wt. %, and more preferably from about to 3 wt. %, of an additive be present in the support, which additive is selected from the group consisting of phosphorus and metals or metal oxides from Group IA (alkali metals) of the Periodic Table of the Elements.

The product stream from the first sulfur removal stage, which will typically contain from about 100 to 1,000 wppm organically bound sulfur as well as hydrogen sulfide that was not removed in the first sulfur removal stage is fractionated in a fractionation zone that is operated to produce a light fraction and a heavy fraction. The fractionation cut will take place at a temperature that will produce a light fraction containing less than about 100 wppm, preferably less than or equal to about 50 wppm, of organically bound sulfur. This temperature will typically be in a range from about 130° F. to 240° F., preferably in the range of about 180° F. to about 210° F. In general, the light fraction will contain relatively high levels of olefins in addition to relatively low levels of sulfur. This lighter fraction will also contain some of the hydrogen sulfide that was produced during first stage hydrodesulfurization by the conversion of organically bound sulfur species. The lighter fraction is stripped of at least a portion of this hydrogen sulfide and is now suitable for blending with the gasoline pool at the refinery. The stripped hydrogen sulfide is disposed of in a safe and environmentally acceptable manner. Any stripping agent can be used that is suitable for this purpose. Conventional stripping agents and stripping conditions are well known in the art and non-limiting stripping agents suitable for use here include fuel gas, nitrogen, and steam.

The heavier fraction will contain relatively high levels of sulfur and relatively low levels of olefins. This heavier fraction is conducted to a second sulfur removal stage that is capable of reducing the level of organically bound sulfur of this heavy fraction. Non-limiting examples of sulfur removal processes that can be used in this second sulfur removal stage include hydrodesulfurization, adsorption, and extraction. Preferred is hydrodesulfurization with selective hydrodesulfurization being more preferred. Such hydrodesulfurization conditions were discussed above. It is preferred that the amount of organosulfur in the light fraction be greater than the amount of organosulfur in the product stream from the second sulfur removal stage as well as being greater than the amount of organosulfur in a stream comprised of both the light fraction and the heavy fraction. It is also preferred that the combined stream contain from about 5 to 50 wppm organosulfur.

In another embodiment, the invention relates to a method for regulating the cut-point in the fractionation step of the naphtha desulfurization process. In the fractionator, where the first product stream is separated into a light fraction and a heavy fraction, the fractionation cut point would be selected at a temperature that results in minimizing the organosulfur present in a combined stream comprising the stripped light fraction and the second product stream. The organosulfur may be minimized into a target sulfur level range, and the target sulfur level will preferably range from about 0 ppm to about 50 ppm, based on the weight of the combined stream. This aspect of the invention is particularly beneficial when selective hydrodesulfurization is employed in the first stage, and more particularly when the reversion mercaptans present following the first stage are heavy mercaptans, such as $C_5$ or $C_6$ mercaptans and higher.

The following examples are presented to illustrate the invention.

EXAMPLE 1 (COMPARATIVE)

A cat naphtha feedstock, whose properties are given in Table 1 below, was selectively hydrodesulfurized in two stages. The first sulfur removal stage used a catalyst comprised of about 4.3 wt. % $MoO_3$ and 1.2 wt. % CoO on an alumina support having a surface area of about 280 $m^2/g$ and a medium pore diameter of about 95 Å. The second sulfur removal stage used a catalyst comprised of about 15.0 wt. % $MoO_3$ and 4.0 wt. % CoO on an alumina support having a surface area of about 260 $m^2/g$ and a medium pore diameter of about 80 Å. Process conditions used in both the first stage and the second stage are set forth in Table 2 below.

TABLE 1

Properties of Cat Naphtha Feed

| | |
|---|---|
| API Gravity | 55.5 |
| Specific Gravity, g/cc | 0.757 |
| Sulfur, wppm | 1385 |
| Bromine Number, cg/g | 70.2 |
| Boiling Point, ° F. | |
| 5 vol % | 141.4 |
| 50 vol % | 209.6 |
| 95 vol % | 354.6 |

TABLE 2

Reactor Conditions

| Operating Conditions | 1st Stage | 2nd Stage |
|---|---|---|
| LHSV, $hr^{-1}$ | 3.4 | 7.0 |
| Reactor EIT, ° F. | 518 | 515 |
| Treat Gas Ratio, SCF/B | 1610 | 2000 |
| Treat Gas Purity, mol. % $H_2$ | 100 | 75 |
| Average Reactor Pressure, psia | 268 | 352 |
| Reactor Outlet $H_2$ partial pressure, psia | 160 | 166 |

The reaction product after the first stage and the product after the second stage were analyzed and the results are shown in Table 3 below.

TABLE 3

Properties of Reactor Products

| | First Stage Product | Second Stage Product |
|---|---|---|
| Total Sulfur, wppm | 168 | 10.5 |
| Bromine Number, cg/g | 56.1 | 34.1 |

This example shows that the cat naphtha, after hydrodesulfurization contains 10.5 wppm sulfur and has a bromine number of 34.1 cg/g. The bromine number translates to an olefin content of about 20.0 wt. %.

EXAMPLE 2

The procedure of Example 1 was followed except the first stage product was fractionated into a $C_5$-195° F. fraction and a 195–430° F. fraction. The first stage product and fractions are characterized in Table 4 below.

TABLE 4

Properties of Product Cuts

| | First Stage Product | C5–195 Cut after First Stage | 195–430 Cut after First Stage |
|---|---|---|---|
| Sulfur, wppm | 168 | 19 | 260 |
| Bromine Number, cg/g | 56.1 | 81.9 | 42.8 |

The nearly sulfur-free $C_5$-195° F. fraction, once stripped of hydrogen sulfide, can go directly to mogas blending. The 195°–430° F. fraction is processed in a second hydrodesulfurization stage to remove most of the sulfur from this cut. Final fraction properties and the properties of the combined full range naphtha are characterized in Table 5 below.

TABLE 5

Second Stage Product and Final Product Blend Properties

| | 195–430° F. Cut after Second Stage | Total $C_5$–430° F. Product after Hydrotreating |
|---|---|---|
| Cat Naphtha Fraction, wt % | 58.28 | 100 |
| Sulfur, wppm | 9.1 | 13 |
| Bromine Number, cg/g | 27.2 | 48.6 |

In this example, the full range naphtha, after hydrodesulfurization contains 13 wppm sulfur and has a bromine number of 48.6 cg/g. The bromine number translates to an olefin content of about 28.5 wt. %.

In order to make a direct comparison between the conventional process without interstage fractionation versus the process of the present invention with interstage fractionation a kinetic model was used to adjust the interstage fractionation case to a product level of 10.5 wppm sulfur at the conditions set forth in Table 6 below with the conventional process. The adjusted results are set forth in Table 7 below.

TABLE 6

Operating Conditions Used With Kinetic Model

| Operating Conditions | 1st Stage | 2nd Stage |
|---|---|---|
| LHSV, $hr^{-1}$ | 3.4 | 3.1 |
| Reactor EIT, ° F. | 518 | 515 |
| Treat Gas Ratio, SCF/B | 1610 | 2000 |
| Treat Gas Purity, mol. % $H_2$ | 100 | 75 |
| Average Reactor Pressure, psia | 253 | 337 |
| Reactor Outlet $H_2$ partial pressure, psia | 160 | 168 |

TABLE 7

Second Stage Product and Final Product Blend Properties

| | 195–430° F. Cut after Second Stage | $C_5$–430° F. cut after Hydrotreating |
|---|---|---|
| Cat Naphtha Fraction, wt % | 58.28 | 100 |
| Sulfur, wppm | 5.0 | 10.5 |
| Bromine Number, cg/g | 17.4 | 42.7 |

In this example, the full range naphtha, after hydrodesulfurization contains 10.5 wppm sulfur and has a bromine number of 42.7 cg/g. The bromine number translates to an olefin content of about 25 wt. %.

By comparison, Example 2 preserves about 5 wt. % more olefins than Example 1 at the same level of desulfurization. Based on an octane correlation developed from pilot plant data, the preservation of about 5 wt. % olefins results in (RON+MON)/2 savings of approximately 0.7 octane number.

What is claimed is:

1. A process for hydrodesulfurizing olefinic naphtha feedstreams and retaining a substantial amount of the olefins, which feedstream boils in the range of about 50° F. (10° C.) to about 450° F. (232° C.) and contains substantial amounts of organically bound sulfur and olefins, which process comprises:

a) hydrodesulfurizing the feedstream in a first sulfur removal stage in the presence of a hydrogen and a hydrodesulfurization catalyst, at hydrodesulfurization reaction conditions including temperatures from about 232° C. (450° F.) to about 427° C. (800° F.), pressures of about 60 to 800 psig, and hydrogen treat gas rates of about 1000 to 6000 standard cubic feet per barrel, to convert at least about 50 wt. % of the organically bound sulfur to hydrogen sulfide and to produce a first product stream containing from about 100 to about 1,000 wppm organically bound sulfur;

b) fractionating said product stream into a light fraction and a heavy fraction, wherein the fractionation cut point is at a temperature such that the light fraction contains less about 100 wppm of organically bound sulfur and some hydrogen sulfide and the heavy fraction contains the remainder of the organically bound sulfur;

c) stripping the light fraction of at least a portion of its hydrogen sulfide;

d) conducting the stripped light fraction away from the process;

e) conducting the heavy fraction to a second sulfur removal stage wherein at least a portion of the remaining organically bound sulfur is removed.

2. The process of claim 1 wherein the cut point is at a temperature wherein the organically bound sulfur level of the light fraction is equal to or less than about 50 wppm.

3. The process of claim 1 wherein the naphtha feedstream contains from about 1,000 to about 6,000 wppm sulfur and up to 60 wt. % olefins concentration.

4. The process of claim 1 wherein the hydrodesulfurization catalyst is comprised of at least one Group VIII metal, and at least one Group VI metal on an inorganic metal support, wherein the Groups are selected from the Periodic Table of the Elements.

5. The process of claim 4 wherein the inorganic oxide support is selected from the group consisting of zeolites, alumina, silica, titania, calcium oxide, strontium oxide, barium oxide, carbons, zirconia, diatomaceous earth, cerium oxide, lanthanum oxide, neodynium oxide, yttrium oxide, and praesodynium oxide; chromia, thorium oxide, urania, niobia, tantala, tin oxide and zinc oxide.

6. The process of claim 5 wherein the Group VIII metal is selected from Ni and Co and the Group VI metal is Mo.

7. The process of claim 6 wherein the amount of Group VIII metal in the hydrodesulfurization catalyst is from about 1 to 5 wt. % and the amount of Group VI metal is from about 1 to 15 wt. %, which weight percents are based on the total weight of the catalyst.

8. The process of claim 1 wherein the hydrodesulfurization catalyst is comprised of a Mo catalytic component, a Co catalytic component and a support component, with the Mo component being present in an amount of from 1 to 10 wt. % calculated as $MoO_3$ and the Co component being present in an amount of from 0.1 to 5 wt. % calculated as CoO, with a Co/Mo atomic ratio of 0.1 to 1.

9. A process for hydrodesulfurizing olefinic naphtha feedstreams and retaining a substantial amount of olefins, which feedstreams boil in the range of about 50° F. to about 430° F. and contain from about 1,500 to 5,000 wppm organically bound sulfur and at least about 5 wt. % olefins, which process comprises:

a) hydrodesulfurizing said feedstream in a first sulfur removal stage in the presence of a first hydrodesulfurization catalyst comprised of at least one Group VIII metal and at least one Group VI metal, at reaction conditions including temperatures from about 450° F. to about 800° F., pressures of about 60 to 150 psig, and hydrogen treat gas rates of about 2000 to 4000 standard cubic feet per barrel, wherein at least about 50 wt. % of the organically bound sulfur is converted to hydrogen sulfide and to produce a first product stream containing from about 100 to 1,000 wppm organically bound sulfur;

b) fractionating said first product stream into a light fraction and a heavy fraction, wherein the fractionation cut point is at a temperature such that the light fraction contains less than about 100 wppm organically bound sulfur and hydrogen sulfide and the heavy fraction contains the remainder of the organically bound sulfur from said first product stream;

c) stripping the light fraction of at least a portion of its hydrogen sulfide;

d) collecting said stripped light fraction;

e) hydrodesulfurizing said heavy fraction in a second sulfur removal stage in the presence of a second hydrodesulfurization catalyst comprised of at least one Group VIII metal and at least one Group VI metal at hydrodesulfurization conditions to remove at least a portion of the organically bound sulfur of said heavy fraction, and to produce a second product stream; and f) combining said stripped light fraction with said second product stream.

10. The process of claim 9 wherein the first and second hydrodesulfurization catalyst further comprise an inorganic oxide support independently selected from the group consisting of zeolites, alumina, silica, titania, calcium oxide, strontium oxide, barium oxide, carbons, zirconia, diatomaceous earth, cerium oxide, lanthanum oxide, neodynium oxide, yttrium oxide, and praesodynium oxide; chromia, thorium oxide, urania, niobia, tantala, tin oxide and zinc oxide.

11. The process of claim 9 wherein the Group VIII metal of the first and second hydrodesulfurization catalyst is selected from Ni and Co and the Group VI metal is Mo.

12. The process of claim 10 wherein the amount of Group VIII metal in the first and second hydrodesulfurization catalyst is from about 1 to 5 wt. % and the amount of Group VI metal is from about 1 to 15 wt. %, which weight percents are based on the total weight of the catalyst.

13. The process of claim 9 wherein the first and second hydrodesulfurization catalyst is comprised of a Mo catalytic component, a Co catalytic component and a support component, with the Mo component being present in an amount of from 1 to 10 wt. % calculated as $MoO_3$ and the Co component being present in an amount of from 0.1 to 5 wt. % calculated as CoO, with a Co/Mo atomic ratio of 0.1 to 1.

14. The process of claim 9 wherein the content of organically bound sulfur in the stripped light fraction is greater than the content of organically bound sulfur in the second product stream.

15. The process of claim 9 wherein the content of organically bound sulfur in the stripped light fraction is greater than the content of organically bound sulfur in the combined stream comprised of both the stripped light fraction and the second product stream.

* * * * *